United States Patent [19]

Ricart

[11] 3,993,266

[45] Nov. 23, 1976

[54] DEVICE FOR FASTENING YARN BOBBINS IN LOOMS

[76] Inventor: Emilio Llovet Ricart, Roger de Flor Street 16, Mataro, Spain

[22] Filed: Dec. 4, 1975

[21] Appl. No.: 637,770

[30] Foreign Application Priority Data

Dec. 17, 1974 Spain ..... 433013

[52] U.S. Cl. ..... 242/130

[51] Int. Cl.[2] ..... B65H 49/02; D03J 5/08

[58] Field of Search ..... 242/130, 130.1, 130.3, 242/130.4, 131, 129.7, 129.71, 129.5; 139/251

[56] References Cited

UNITED STATES PATENTS

| | | | |
|---|---|---|---|
| 2,636,696 | 4/1953 | McBride | 242/130.1 |
| 2,681,189 | 6/1954 | Huber | 242/130 |
| 3,865,330 | 2/1975 | Widmer | 242/130 |

*Primary Examiner*—Leonard D. Christian
*Attorney, Agent, or Firm*—Haseltine, Lake & Waters

[57] ABSTRACT

An arrangement for fastening in place yarn bobbins in looms, in which a support member fastened to the loom plate holds a shaft member at an inclined angle. A lower ring-shaped bobbin holder passes over the shaft member and supports the lower end of a bobbin held on the shaft member. The lower bobbin holder is freely axially movable on the shaft member. A spring is disposed between the shaft support and the lower bobbin holder. The bobbin is held in place at the upper end by a replaceable ring-shaped member having a predetermined taper to accommodate bobbins of various diameters, lengths and shapes. A locking ring bearing against a projection on the free end of the shaft, holds the bobbin together with the lower and upper retaining rings in place on the shaft. Spacers are applied on the shaft between the upper replaceable ring and the locking ring, as required, to accommodate bobbins of varying lengths.

10 Claims, 2 Drawing Figures

DEVICE FOR FASTENING YARN BOBBINS IN LOOMS

BACKGROUND OF THE INVENTION

The present invention relates to the fastening of yarn bobbins in looms.

Conventional devices for fastening yarn bobbins in looms, heretofore, require use of special tools to mount and remove bobbins from their respective operative locations. Furthermore, the devices used to hold the bobbins in place require considerable skilled personnel able to use their special tools in obtaining proper mounting of the bobbins. The conventional designs are substantially complex and require considerable time of the operator to replace a bobbin.

The conventional construction of the bobbin fastening devices, moreover, involve special manipulations of the operator, which may result in injury to the operator in the event that the latter is not fully alert.

Another disadvantage of the conventional bobbin fastening devices is that they are not adapted to fasten in place bobbins of varying sizes and shapes. The operator is required to assemble different parts when different bobbins are to be accommodated, and in some machines it is not possible to use bobbins of varying sizes and shapes.

Accordingly, it is an object of the present invention to provide a yarn bobbin fastening arrangement in which a bobbin may be held securely in place without requiring special tools by a machine operator.

Another object of the present invention is to provide a yarn bobbin fastening arrangement in which bobbins of varying sizes, lengths and tapers may be accommodated.

A still further object of the present invention is to provide a yarn bobbin fastening arrangement of the foregoing character which is accessible to the machine operator and in which the bobbins may be replaced quickly within a relatively short period of time.

Yet another object of the present invention is to provide a yarn bobbin fastening arrangement, as described, which is simple in design and construction and may be economically fabricated.

SUMMARY OF THE INVENTION

The objects of the present invention are achieved by providing a bobbin fastening arrangement in which an incline support is fastened, at its base, to the loom plate. The support holds one end of a shaft directed upward at an inclined angle. Axially sliding on the shaft, are two ring-shaped members which bear against opposite ends of the bobbin when holding the latter in place on the shaft. The upper ring-shaped member bearing against the upper end of the bobbin, is replaceable to provide for variations in bobbins with respect to diameter, length, and taper.

A compression spring between the support and the lower ring-shaped member, forces the upper ring-shaped member to bear against a locking ring at the upper end of the shaft. The locking ring, in turn, bears against a projection on the shaft end to hold the elements on the shaft in place. Spacers between the upper-end shaped member and the locking member allow for accommodating bobbins of varying lengths.

The locking member is a disc-shaped element having slotted openings at right angles to each other for allowing the projection to pass through the disc when the latter is in predetermined position, and which prevent the projection from passing therethrough after rotation of the disc by 180°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
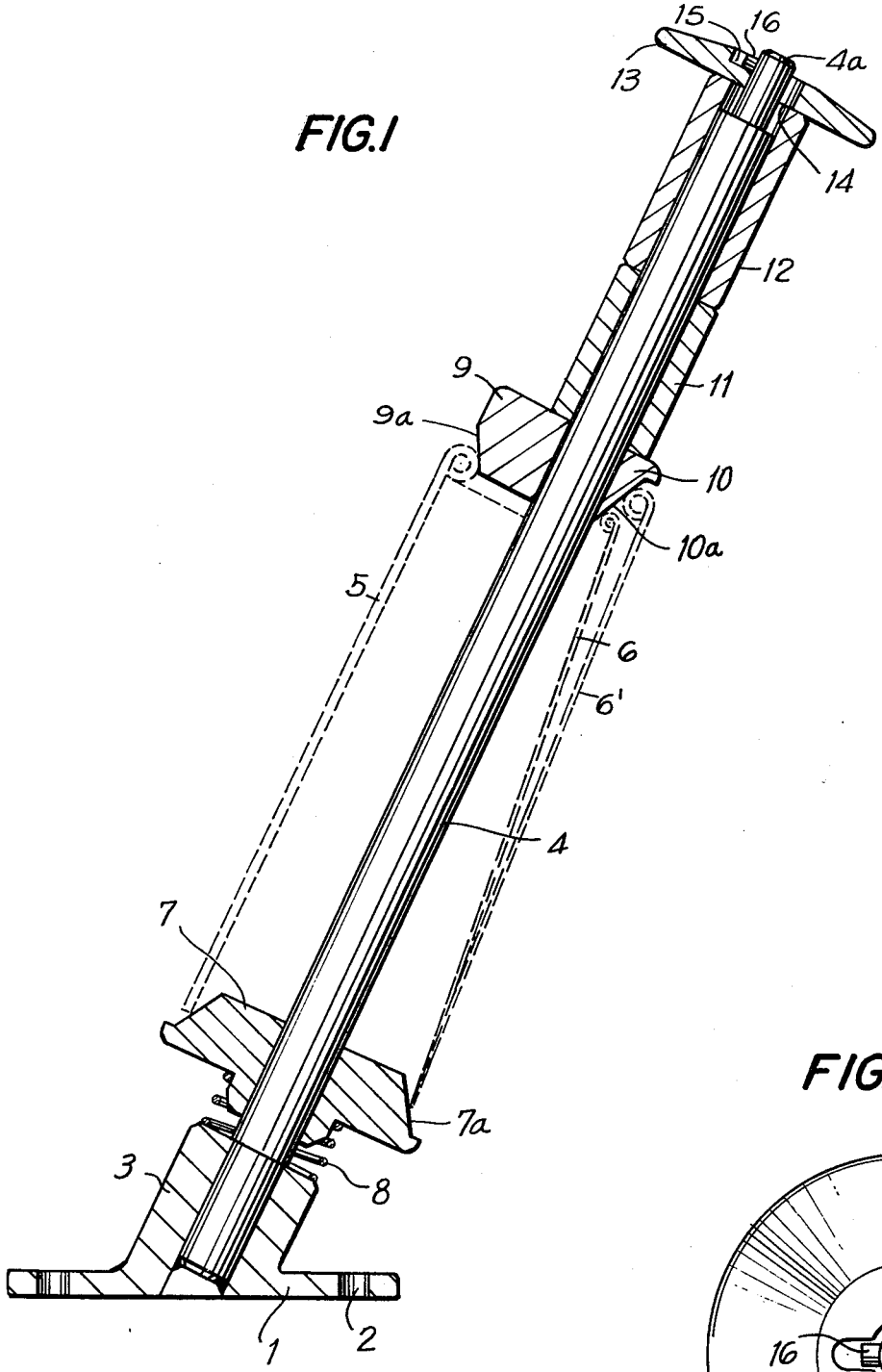
FIG. 1 is a sectional elevational view and shows the essential elements in assembled arrangement, according to the present invention.
Figure 2:
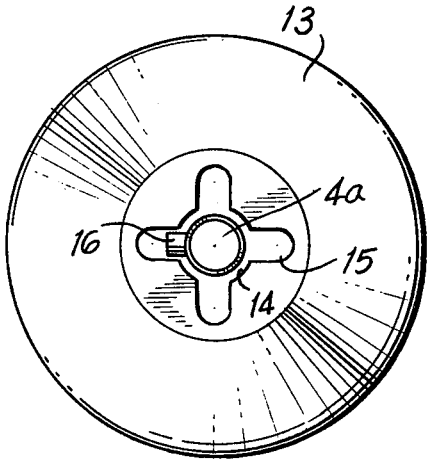
FIG. 2 is a plan view on an enlarged scale of a locking member used in the arrangement of FIG. 1.

Referring to the drawing, there is provided in accordance with the present invention, a support base 1 with holes or openings 2 for mounting against a loom plate. An inclined support portion 3 on the base 1, supports a shaft or bar member 4 at an inclined angle.

Axially slidable on the inclined shaft 4, is a lower ring-shaped bobbin holder 7. The latter is provided with a tapered peripheral surface 7*a* which extends into the lower end of a bobbin 5, to be fastened in place in accordance with the present invention. A compression spring 8 passing over the shaft 4, is in the operative state, compressed between the upper surface of the inclined portion 3 and the lower surface of the bobbin holder 7.

An upper ring-shaped member 9 in the form of a replaceable element, presses, in the operative state, against the upper end of the bobbin 7 which has a substantially cylindrical shape. The element 9 has a tapered bearing surface 9*a* which extends into the upper end of the bobbin 5 to hold the latter securely in place. For purposes of accommodating bobbins with varying lengths and tapers, a replaceable element 10 is provided with bearing surface 10*a* for pressing against bobbin ends of different diameters due to for example, different tapered lengths. Accordingly, the replacement elements 9 and 10 may be designed with a profile so as to accommodate substantially any bobbin used in the trade.

At the upper end of the shaft 4, there is provided in reduced cross-section, a shank portion 4*a* of the shaft. A locking ring 3, in the form of a disc-shaped member, has an opening for passing over the shank shaft portion 4*a*. In conjunction with the circular opening of the locking disc 13, there are provided slotted openings 14 spaced angularly at right angles from each other. The shaft portion 4*a* is provided with a projecting key element 16 which projects diametrically from the shaft. The key element 16 passes through the openings 14 in the locking disc 13. The latter is provided, furthermore, with a bearing portion 15 against which the key element 16 can bear or press when the locking disc is in predetermined angular position.

In operation of the fastening arrangement of the present invention, the bobbin 5 to be fastened in place is slipped over the inclined shaft 4 and onto the lower bobbin holder 7. The replaceable upper ring-shaped element 9, for example, is then passed over the shaft 4 and brought against the upper end of the bobbin 5. Spacer elements 11 and 12 are then slipped over the shafts 4, as required, to accommodate the particular length of the bobbin 5. Thereafter, the locking disc 13 is passed over the shaft portion 4*a* and pushed downward so that the key element 16 passes through an opening 14 of the disc. The latter is then rotated 180° so that the key portion 16 is brought opposite the bearing portion 15, and the disc member 13 is released. The key element 16 thereupon presses against the bearing portion 15 and holds the bobbin 5 securely in place between the elements 7 and 9.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention, and therefore, such adaptations should and are intended to be comprehended within the meaning and range of equivalence of the following claims.

I claim:

1. An arrangement for fastening yarn bobbins in looms comprising, in combination, a support fastenable to a loom plate; a bar member joined at one end to said support for receiving a bobbin; a lower ring-shaped member in proximity of said support and axially movable on said bar member for holding one end of said bobbin; an upper ring-shaped member with predetermined tapered peripheral surface for bearing against the other end of said bobbin, said upper ring-shaped member being axially movable on said bar member; locking means on the other end of said bar member for locking to said bar member to retain said bobbin with lower and upper ring-shaped members on said bar member; and elastic means between said support and lower ring-shaped member for applying spring action to for said upper and lower ring-shaped members against the respective ends of the bobbin, said upper ring-shaped member being forced against said locking means by said elastic means.

2. The arrangement as defined in claim 1 wherein said bar member is held by said support at an inclined angle.

3. The arrangement as defined in claim 2 wherein said support has a base with openings for fastening to a loom plate.

4. The arrangement as defined in claim 3 wherein in said elastic means comprises a compression spring.

5. The arrangement as defined in claim 4 wherein said upper ring-shaped member has a predetermined taper for bearing against a bobbin of predetermined size.

6. The arrangement as defined in claim 5 wherein said lower ring-shaped member has a tapered portion supporting one end of said bobbin.

7. The arrangement as defined in claim 6 including spacer means between said upper ring-shaped member and said locking means.

8. The arrangement as defined in claim 7 including projection means on said other end of said bar member and passing through said locking means in predetermined position of said locking means, said projecting means being inhibited from passing through said locking means in a predetermined locking position of said locking means.

9. The arrangement as defined in claim 8 including a plurality of slotted openings in said locking means for passing said projecting means therethrough.

10. The arrangement as defined in claim 9 wherein said slotted openings are spaced equiangularly about the axis of said bar member and communicating with an opening through said locking means passing over said other end of said bar member, said projecting means passing freely through a slotted opening in a predetermined position of said locking means and being inhibited from passing through said locking means after said locking means has been rotated substantially 180° from said predetermined position of said locking means.

* * * * *